US006673450B2

(12) United States Patent
Boyle et al.

(10) Patent No.: US 6,673,450 B2
(45) Date of Patent: Jan. 6, 2004

(54) SOFT HAND, LOW LUSTER, HIGH BODY CARPET FILAMENTS

(75) Inventors: John B. Boyle, Chester, VA (US); Alexander Lobovsky, New Providence, NJ (US); James A. Matrunich, Mountainside, NJ (US); Carole G. Shealy, Irmo, SC (US); Bruce W. Portus, Lexington, SC (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/073,739

(22) Filed: Feb. 11, 2002

(65) Prior Publication Data

US 2003/0157319 A1 Aug. 21, 2003

(51) Int. Cl.[7] ..... D01F 6/00

(52) U.S. Cl. ..... 428/397; 428/400; 428/394; 428/364

(58) Field of Search ..... 428/397, 364, 428/394, 400

(56) References Cited

U.S. PATENT DOCUMENTS

| | | | | |
|---|---|---|---|---|
| 2,939,201 A | | 6/1960 | Holland | 28/82 |
| 3,097,416 A | | 7/1963 | McKinney | 28/82 |
| 3,508,390 A | | 4/1970 | Bagnall et al. | 57/140 |
| 4,001,369 A | | 1/1977 | Shah | 264/177 F |
| 4,492,731 A | | 1/1985 | Bankar et al. | 428/362 |
| 4,648,830 A | | 3/1987 | Peterson et al. | |
| 4,770,938 A | | 9/1988 | Peterson et al. | 428/398 |
| 4,812,361 A | * | 3/1989 | Takemoto et al. | 428/397 |
| 5,057,368 A | | 10/1991 | Largman et al. | 428/397 |
| 5,108,838 A | * | 4/1992 | Tung | 428/357 |
| 5,208,106 A | * | 5/1993 | Tung | 428/397 |
| 5,322,736 A | | 6/1994 | Boyle et al. | 428/397 |
| 5,356,582 A | | 10/1994 | Aneja et al. | 264/103 |
| 5,380,592 A | | 1/1995 | Tung | 428/397 |
| 5,387,469 A | * | 2/1995 | Warren | 428/397 |
| 5,532,060 A | | 7/1996 | Aneja et al. | 428/398 |
| 5,585,182 A | | 12/1996 | Aneja et al. | 428/398 |

FOREIGN PATENT DOCUMENTS

EP 0 982 414 A1 3/2000 ..... D01D/5/24

OTHER PUBLICATIONS

John Southern, Jing–Peir Yu, William Baggett and Richard Miller, "Fundamental Physics of Carpet Performance", *J. Appl. Poly. Sci., Appl. Poly. Symp., 47,* 355–371 (1991).

George B.Thomas Jr. and Ross L. Finney, "Calculus and Analytic Geometry", Fifth Ed., Addison–Wesley, Reading, Mass., pp. 553–554, 1968.

* cited by examiner

*Primary Examiner*—N. Edwards
(74) *Attorney, Agent, or Firm*—Virginia Szigeti; Margaret S. Millikin

(57) ABSTRACT

Novel filaments and yarns for carpets, upholstery and other applications, the spinneret and method for their production and carpets manufactured therefrom. The filaments of the invention are solid multi-lobal filaments of complex convex-concave surface contour possessing low luster, low moment of inertia, high color intensity upon dyeing and high covering power. Carpets manufactured therefrom possess low luster, soft hand, high covering power and high body suitable for premium residential application. The filaments of the invention are produced at high throughput and productivity by the method of the invention.

12 Claims, 7 Drawing Sheets

FIGURE 4
FIG. 4a
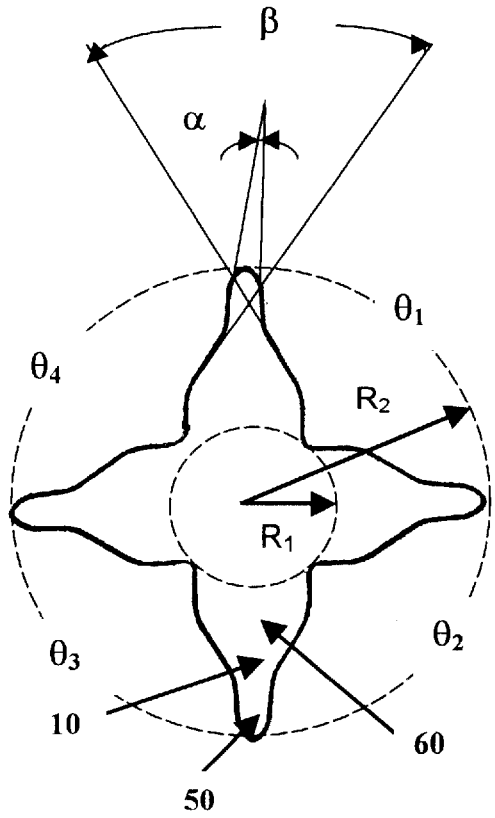
FIG. 4b
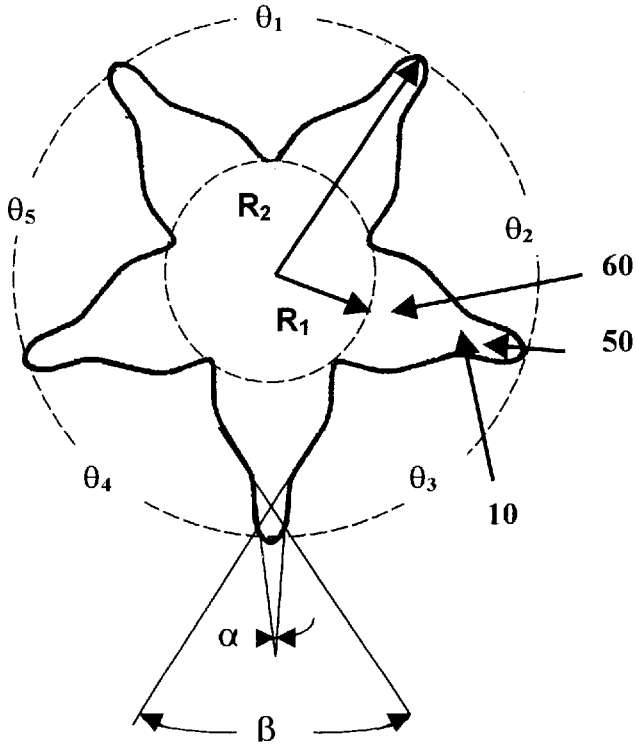

CAPILLARY DETAIL

SOFT HAND, LOW LUSTER, HIGH BODY CARPET FILAMENTS

BACKGROUND OF THE INVENTION

1. Field of the Invention

This invention relates to novel filaments and yarns for carpets, upholstery and other applications, the spinneret and method for their production and carpets manufactured therefrom. The filaments of the invention are solid multi-lobal filaments of complex convex-concave surface contour possessing low luster, low moment of inertia, high color intensity upon dyeing, and high covering power. Carpets manufactured therefrom possess low luster, soft hand, and high body suitable for premium residential application.

2. Description of the Related Art

A large number of the carpets used in residences in the United States are known as cut pile carpets. In their manufacture, pile yarn is inserted into a backing material as loops. The loops are cut to form vertical tufts and then sheared. Cut-pile carpet is customarily produced from staple yarns or bulked continuous filament yarn. Bulked (texturized or crimped) continuous filament nylon yarn is produced according to various conventional methods. Twisting, entangling, or direct cabling may be utilized in various processes. Multiple ends of twist set yarns are tufted into cut pile carpet and conventionally finished to obtain the desired carpet product.

The perceived value of carpets is dependent upon several factors including carpet body, luster, color intensity, and increasingly softness of hand. It is known that carpet body can be improved by increasing the face weight of the carpet or by increasing the crimp imposed on the face fiber. However, carpet face weight is directly proportional to the carpet's total production cost. Furthermore, highly crimped fiber can create processing problems. A need exists for carpet yarns that may be tufted into carpets to provide good carpet body in such a manner that the above problems are avoided.

Softness of hand for a given fibrous material depends upon the denier of the filaments in the yarn, yarn twist, and the fiber cross-section. Smaller denier fibers yield improved softness but may be more costly and difficult to produce. Lower twist increases softness but reduces resistance to wear (appearance loss). The manufacture of carpet yarns is a highly competitive industry under significant price pressures. A need exists for carpet yarns that possess greater softness of hand but that may be produced without increasing costs or reducing appearance retention.

The denier and shape of the fiber cross-section determine the moment of inertia and the covering power of the fiber cross-section. Cross-sectional shapes having high moments of inertia have high covering power but possess less softness of hand. A need exists for carpet yarns that possess a desirable balance of covering power and softness of hand.

For many styles of carpet, yarns having a low luster are required. Fibers having a circular cross-section have the requisite low luster but have poorer covering power than fibers with lobal cross-sections. A need exists for carpet yarns possessing a desirable balance of covering power and low luster.

The color intensity produced by dyeing may vary with the filament cross-section and the manner in which light is reflected and absorbed. A need exists for carpet yarns possessing ease of dyeing to high color intensity.

There is a long history of prior art yarns that had the objectives of improving the properties of carpets by design of the constituent fiber cross-sections. Fibers or filaments having trilobal and tetralobal cross-sections have been widely used for carpet yarns due to their bulk and covering power advantages over fibers having round or ribbon cross-sections. Solid trilobal filaments are described for example in U.S. Pat. No. 2,939,201 to Holland; U.S. Pat. No. 3,097,416 to McKinney, U.S. Pat. No. 3,508,390 to Bagnall et al.; U.S. Pat. No. 4,001,360 to Shah; U.S. Pat. No. 4,492,731 to Bankar et al.; U.S. Pat. No. 5,057,368 to Largman et al.; and U.S. Pat. Nos. 5,108,838 and 5,208,106 to Tung. Hollow trilobal fibers are described for example in U.S. Pat. No. 4,770,938 to Peterson et al.; U.S. Pat. No. 5,322,736 to Boyle; U.S. Pat. No. 5,380,592 to Tung and European Patent 982 414 A1 to Bernaschek. The disclosures of U.S. Pat. Nos. 3,508,390 and 5,322,736 are hereby incorporated herein by reference to the extent not incompatible herewith.

Each of the fibers and carpet yarns cited above represented progress toward the goals to which they were directed. However, none described the specific constructions of the filaments and yarns of this invention and none satisfied all of the needs met by this invention.

SUMMARY OF THE INVENTION

This invention relates to: novel filaments for use in carpets, upholstery and other applications; a method and spinneret used for their production; and yarns and carpets manufactured therefrom. The filaments of the invention are solid multi-lobal filaments of complex convex-concave surface contour possessing a low moment of inertia, low luster, and high covering power. One embodiment of this invention, among others, is a filament comprising: a solid cross-section having a modification ratio of about 2.4 to about 5 and having a perimeter comprised of a plurality of lobes that are joined to one another by concave line segments. Upon traversing in one direction completely around the perimeter of the filament cross-section, the position of the center of curvature for the perimeter changes from one side of the perimeter to the other side at least eighteen times.

The filaments of the invention possess superior combinations of low luster, easy dyeing to high color intensity, high body, soft hand and high covering power.

The invention includes as embodiments yarns comprising filaments of the invention and carpets comprising yarns of the invention. The invention also includes as embodiments the spinnerets used to make the filaments of the invention and the method of producing the filaments of the invention.

BRIEF DESCRIPTION OF THE DRAWINGS

In the accompanying drawing figures:

FIGS. 1, 2, 3 and 4 are transverse cross-sectional views of different embodiments, among others, of a filament of the invention.

FIGS. 1–3 show trilobal filaments of the invention.

FIGS. 4*a* and 4*b* show, respectively, tetralobal and pentalobal filaments of the invention.

DETAILED DESCRIPTION OF THE INVENTION

Figure 1:
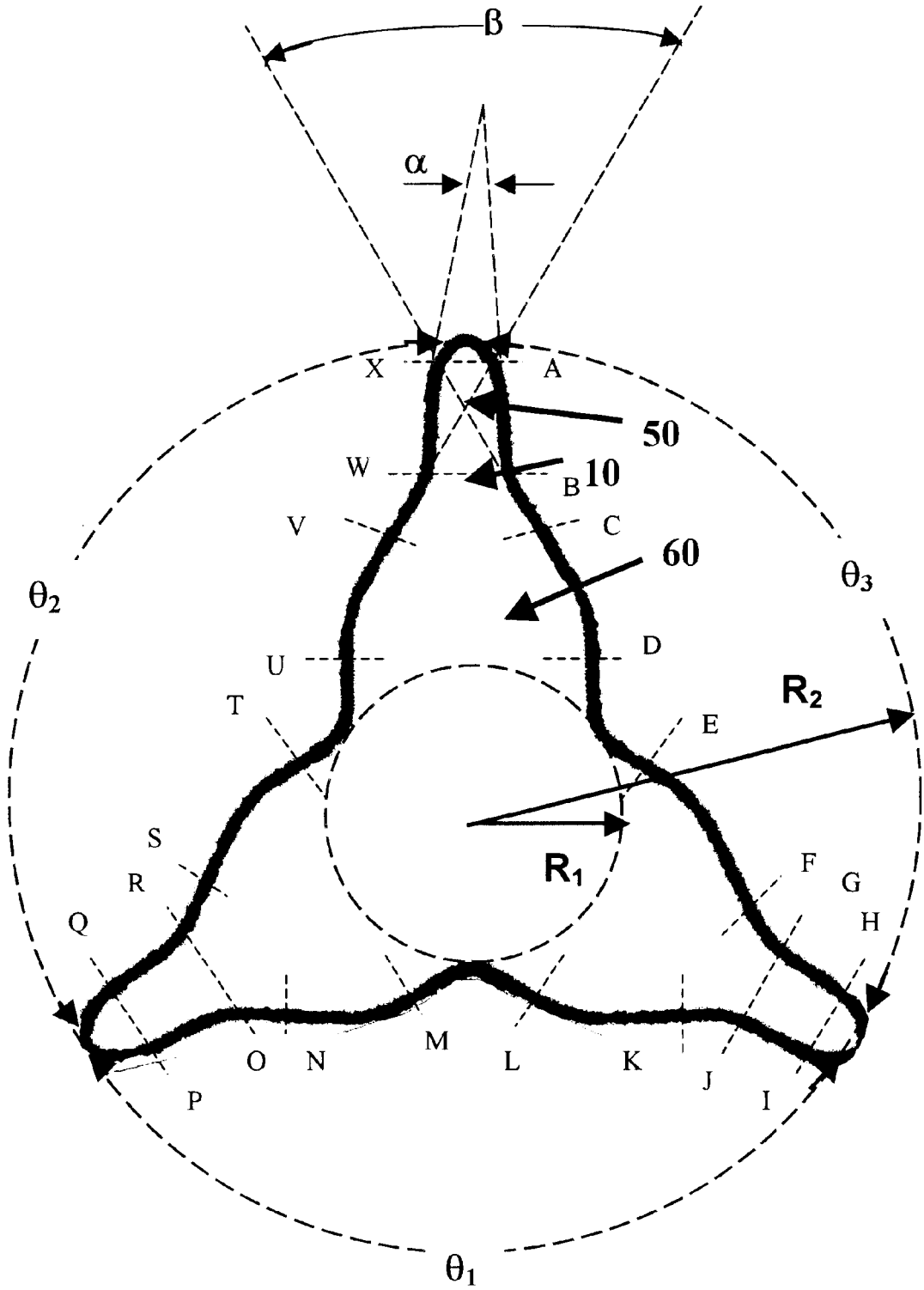

The filaments of the invention are of low moment of inertia, low luster, and high covering power. Carpets manufactured therefrom possess soft hand, low luster and high body suitable for premium residential application. The filaments of the invention may be produced at high throughput even at low deniers.

As used herein throughout, the terms "fiber" and "filament" are synonymous. A filament or fiber comprises a polymer or copolymer which has been formed into an article of extremely long length conventionally known as continuous filament, or a polymer or copolymer which has been formed into an article of extremely long length and then cut or chopped into shorter lengths, conventionally known as staple.

In each embodiment, a filament of the invention is comprised of a solid multi-lobal cross-section with a modification ratio of about 2.4 to about 5. Concave line segments join the perimeters of the lobes. Upon traversing in one direction completely around the perimeter of the filament cross-section, the position of the center of curvature changes from one side of the perimeter to the other side at least eighteen times. In the context of this invention, multi-lobal means two or more lobes, and preferably at least three lobes. The set of embodiments includes, among others, trilobal, tetralobal and pentalobal filaments.

In one subset of embodiments, each lobe of the filament is comprised of a convex region; a concave transition region; and a nipple section extending to the outermost point of the lobe, with the nipple section having lateral walls selected from the group consisting of elliptical, parabolic or straight.

In another subset of embodiments, each lobe of the filament is comprised of a first convex region; a first concave transition region; a second convex region; a second concave transition region; and a nipple section extending to the outermost point of the lobe, with the nipple section having lateral walls selected from the group consisting of elliptical, parabolic or straight.

In yet another subset of embodiments, each lobe of the filament has a composite curve profile having a first arm angle $\alpha$ of about 5° to about 30°; and a second arm angle $\beta$ of about 60° to about 85°; and a nipple section extending to the outermost point of the lobe, with the nipple section having lateral walls selected from the group consisting of elliptical, parabolic and straight.

In one other subset of embodiments, each lobe has a composite curve profile having a first arm angle $\alpha$ of about 5° to about 30°; a second arm angle $\beta$ of about 60° to about 85°; and a third arm angle $\gamma$ of about 60° to about 85°; and a nipple section extending to the outermost point of the lobe, with the nipple section having lateral walls selected from the group consisting of elliptical, parabolic and straight.

The complex convex-concave surface profile of a filament of the invention provides the requisite low luster at the same time as it provides high covering power, high body, and low moment of inertia.

Figure 2:
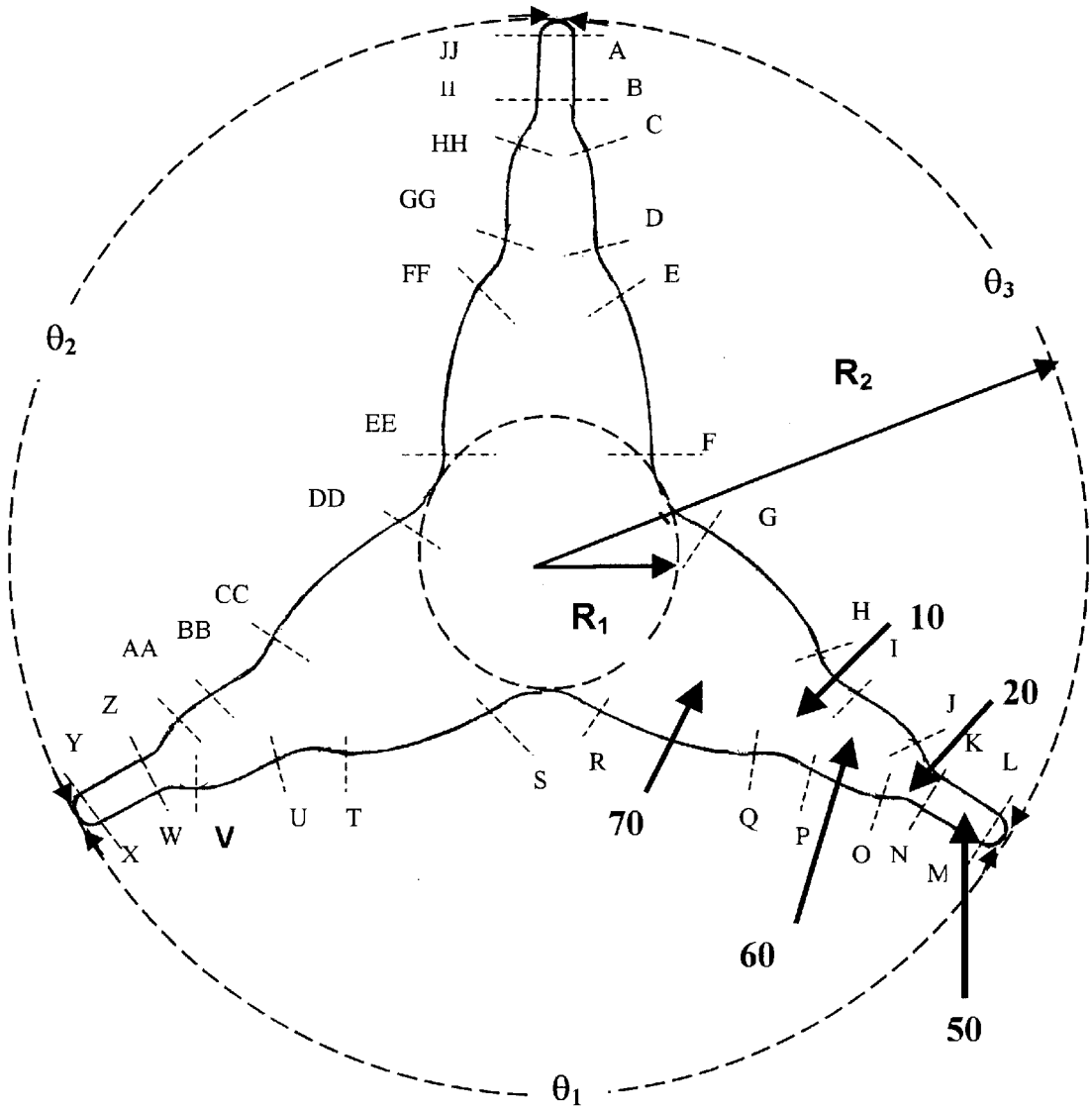
Figure 3:
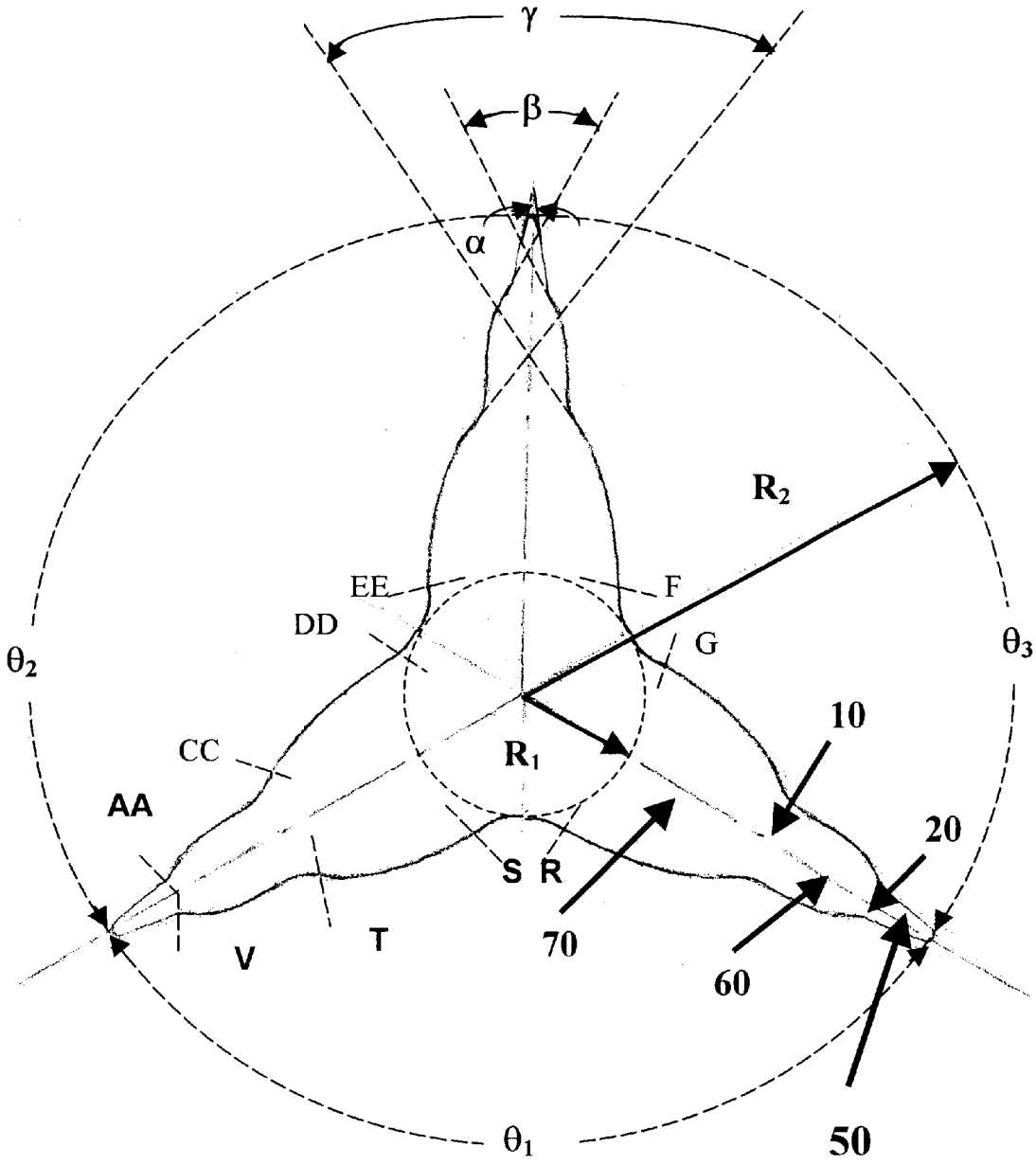

"Modification ratio" is a well-known measure of the cross-section of a trilobal filament and is defined, for example in U.S. Pat. No. 4,492,731, incorporated herein by reference to the extent not incompatible herewith. As shown in FIGS. 1, 2 and 3, "modification ratio" means the ratio of the radius $R_2$ of the circumscribed circle to the radius $R_1$ of the inscribed circle. Preferably, the modification ratio is about 2.5 to about 3.5.

In each embodiment the perimeter of a filament cross-section has a complex convex-concave contour comprised of arcuate line segments. The arcuate segments of a filament perimeter are parabolic or elliptical but it is not necessary that they be geometrically exact parabolic or elliptical segments. The filament perimeters of the embodiments illustrated in FIGS. 1–4 are additionally comprised of straight-line segments.

With respect to the transverse cross-section shown in FIG. 1, the curvature of the arcuate segments and the position of the center of curvature relative to the perimeter are as shown in Table I. The center of curvature is defined in plane analytic geometry as the center of the circle of curvature. See for example Thomas Jr. et al., "Calculus and Analytic Geometry", Fifth Ed., Addison-Wesley, Reading, Mass., pp. 553–554, 1968. The circle of curvature is defined as the circle tangent to a plane curve at a point, whose center lies on the concave side of the curve, and which has the same curvature as the curve itself at this point.

In the trilobal embodiment illustrated in FIG. 1, the filament cross-section has a modification ratio of 2.4 to 5.0 and each lobe is comprised of a convex region 60, a concave transition region 10, and a nipple section 50 extending to the outermost point of the lobe, with the nipple section having lateral walls that are straight and converging. Concave line segments D-E, L-M and T-U join the perimeters of the lobes.

Upon traversing clock-wise around the transverse cross-section shown in FIG. 1, the curvature of the arcuate perimeter segments and the position of the center of curvature relative to the perimeter are as shown in Table I.

TABLE I

| Line Segment | Curvature | Position of Center of Curvature Relative to Perimeter |
|---|---|---|
| A–B | None | — |
| B–C | Concave | Left |
| C–D | Convex | Right |
| D–E | Concave | Left |
| E–F | Convex | Right |
| F–G | Concave | Left |
| G–H | None | — |
| H–I | Convex | Right |
| I–J | Concave | Left |
| K–L | Convex | Right |
| L–M | Concave | Left |
| M–N | Convex | Right |
| N–O | Concave | Left |
| O–P | None | — |
| P–Q | Convex | Right |
| Q–R | None | — |
| R–S | Concave | Left |
| S–T | Convex | Right |
| T–U | Concave | Left |
| U–V | Convex | Right |
| V–W | Concave | Left |
| W–X | None | — |
| X–A | Convex | Right |

It may be verified that upon traversing in one direction completely around the perimeter of the filament of FIG. 1, the position of the center of curvature changes from one side of the perimeter to the other side eighteen times.

In another embodiment (not illustrated), the trilobal filament cross-section has a modification ratio of 2.4 to 5.0, wherein the perimeters of the lobes are joined by concave line segments, and each lobe is comprised of a convex region, a concave transition region, and a nipple section extending to the outermost point of the lobe, with the lateral walls of the nipple section having essentially straight parallel walls.

In yet another embodiment (not illustrated), the trilobal filament cross-section has a modification ratio of 2.4 to 5.0, wherein the perimeters of the lobes are joined by concave line segments, and each lobe is comprised of a convex region, a concave transition region, and a nipple section extending to the outermost point of the lobe with a parabolic or elliptical perimeter.

Another measure of the shape of multi-lobal filaments in addition to the modification ratio is the arm angle. Arm angles have been used to describe the filaments of U.S. Pat. Nos. 4,492,731 and 5,322,736. The composite curved profile of a filament of the present invention requires multiple arm angle measurements.

As also illustrated in FIG. 1, the inventive filament comprises a solid trilobal cross-section with a modification ratio of about 2.4 to about 5; wherein the perimeters of the multiple lobes are joined by concave line segments; and wherein each lobe has a composite curve profile having a first arm angle $\alpha$ of about 5° to about 30°; and a second arm angle $\beta$ of about 60° to about 85°; and a nipple section extending to the outermost point of the lobe.

The first arm angle $\alpha$ is measured by the angle between the lateral walls of the nipple-shaped section 50. The second arm angle $\beta$ is measured by the tangent to the perimeter of the convex region at the terminal points of the convex region labeled W and B and the corresponding points on each lobe. The terminal points of the convex regions are those points at which the position of the center of curvature changes from one side of the perimeter to the other.

The first arm angle $\alpha$ ranges from 5° to 30°, preferably 10° to 25°. The second arm angle $\beta$ ranges from 60° to 85°, preferably 70° to 80°. The angles $\theta_1,\theta_2,\theta_3$ between the lobes of the filament are about 100° to about 140°, preferably about 120°.

In the embodiment illustrated in FIG. 2, each lobe of the trilobal filament is comprised of a first convex region 70, a first concave transition region 10, a second convex region 60, a second concave transition region 20, and a nipple section 50 extending to the outermost point of the lobe, with the lateral walls of the nipple section being essentially straight and parallel. Concave line segments F-G, R-S, and DD-EE join the lobes of the filament.

In this embodiment, line segment II-JJ is essentially parallel to line segment A-B, line segment K-L is essentially parallel to line segment N-M and line segment W-X is essentially parallel to line segment Y-Z.

With respect to the transverse cross-section shown in FIG. 2, the curvature of the arcuate perimeter segments and the position of the center of curvature relative to the perimeter are as shown in Table II.

TABLE II

| Line Segment | Curvature | Position of Center of Curvature Relative to Perimeter |
|---|---|---|
| A–B | None | — |
| B–C | Concave | left |
| C–D | Convex | right |
| D–E | Concave | left |
| E–F | Convex | right |
| F–G | Concave | left |
| G–H | Convex | right |
| H–I | Concave | left |
| I–J | Convex | right |
| J–K | Concave | left |
| K–L | None | — |

TABLE II-continued

| Line Segment | Curvature | Position of Center of Curvature Relative to Perimeter |
|---|---|---|
| L–M | Convex | right |
| M–N | None | — |
| N–O | Concave | left |
| O–P | Convex | right |
| P–Q | Concave | left |
| Q–R | Convex | right |
| R–S | Concave | left |
| S–T | Convex | right |
| T–U | Concave | left |
| U–V | Convex | right |
| V–W | Concave | left |
| W–X | None | — |
| X–Y | Convex | right |
| Y–Z | None | — |
| Z–AA | Concave | left |
| AA–BB | Convex | right |
| BB–CC | Concave | left |
| CC–DD | Convex | right |
| DD–EE | Concave | left |
| EE–FF | Convex | right |
| FF–GG | Concave | left |
| GG–HH | Convex | right |
| HH–II | Concave | left |
| II–JJ | None | — |
| JJ–A | Convex | right |

It may be verified that upon traversing in one direction completely around the perimeter of the filament cross-section of FIG. 2, the position of the center of curvature changes from one side of the perimeter to the other side thirty times.

The angles $\theta_1,\theta_2,\theta_3$ between the lobes of the filament are about 100° to about 140°, preferably about 120°.

In another embodiment (not illustrated) the trilobal filament cross-section has a modification ratio of 2.4 to 5.0, wherein the perimeters of the lobes are joined by concave line segments, and each lobe is comprised of a first convex region, a first concave transition region, a second convex region, a second concave transition region, and a convex nipple section with a parabolic or elliptical perimeter. The angles $\theta_1,\theta_2,\theta_3$ between the lobes of the filament are about 100° to about 140°, preferably about 120°.

In the embodiment illustrated in FIG. 3, the trilobal filament cross-section has a modification ratio of 2.4 to 5.0, wherein the perimeters of the lobes are joined by concave line segments, and each lobe is comprised of a first convex region 70, a first concave transition region 10, a second convex region 60, a second concave transition region 20, and a nipple section 50 extending to the outermost point of the lobe, with the nipple section having lateral walls that are straight and converging. The embodiment illustrated in FIG. 3 comprises the same arcuate line segments as in the embodiment of FIG. 2. Moreover, the embodiment illustrated in FIG. 3 has a composite curve profile having a first arm angle $\alpha$ ranging from about 5° to about 30°, a second arm angle $\beta$ ranging from about 60° to about 85°, and a third arm angle $\gamma$ ranging from about 60° to about 85°. Preferably $\beta$ ranges from about 70° to about 80° and $\gamma$ ranges from about 70° to about 85°. The angles $\theta_1,\theta_2,\theta_3$ between the lobes of the filament are about 100° to about 140°, preferably about 120°.

As shown in FIG. 3, the first arm angle $\alpha$ is measured by the angle between the lateral walls of the nipple-shaped section 50. The second arm angle $\beta$ is measured by the tangent to the perimeter of the convex region 60 at its terminal points labeled AA and V and the corresponding points on each lobe. The third arm angle $\gamma$ is measured by the tangent to the perimeter of the convex region 70 at its terminal points labeled CC and T and the corresponding points on each lobe.

In the tetralobal embodiment illustrated in FIG. 4*a,* the filament cross-section has a modification ratio of 2.4 to 5.0 and each lobe is comprised of a convex region 60, a concave transition region 10, and a nipple section 50 extending to the outermost point of the lobe, with the nipple section having lateral walls that are straight and converging. Concave line segments join the perimeters of the lobes. The angles $\theta_1$ to $\theta_4$ between the lobes of the filament are about 80° to about 100°, preferably about 90°.

As also illustrated in FIG. 4*a,* the inventive filament comprises a solid tetralobal cross-section with a modification ratio of about 2.4 to about 5; wherein the perimeters of said lobes are joined by concave line segments; and wherein each lobe has a composite curve profile having a first arm angle $\alpha$ of about 5° to about 30°; and a second arm angle $\beta$ of about 60° to about 85°; and a nipple section extending to the outermost point of the lobe.

In another embodiment (not illustrated), the tetralobal filament cross-section has a modification ratio of 2.4 to 5.0, wherein the perimeters of the lobes are joined by concave line segments, and each lobe is comprised of a convex region, a concave transition region, and a nipple section extending to the outermost point of the lobe, with the lateral walls of the nipple section having essentially straight parallel walls.

In yet another embodiment (not illustrated), the tetralobal filament cross-section has a modification ratio of 2.4 to 5.0, wherein the perimeters of the lobes are joined by concave line segments, and each lobe is comprised of a convex region, a concave transition region, and a nipple section extending to the outermost point of the lobe with a parabolic or elliptical perimeter.

In the pentalobal embodiment illustrated in FIG. 4*b,* the filament cross-section has a modification ratio of 2.4 to 5.0 and each lobe is comprised of a convex region 60, a concave transition region 10, and a nipple section 50 extending to the outermost point of the lobe, with the nipple section having lateral walls that are straight and converging. Concave line segments join the perimeters of the lobes. The angles $\theta_1$ to $\theta_5$ between the lobes of the filament are about 60° to about 80°, preferably about 72°.

As also illustrated in FIG. 4*b,* the inventive filament comprises a solid pentalobal cross-section with a modification ratio of about 2.4 to about 5; wherein the perimeters of said lobes are joined by concave line segments; and wherein each lobe has a composite curve profile having a first arm angle $\alpha$ of about 5° to about 30°; and a second arm angle $\beta$ of about 60° to about 85°; and a nipple section extending to the outermost point of the lobe.

In another embodiment (not illustrated), the pentalobal filament cross-section has a modification ratio of 2.4 to 5.0, wherein the perimeters of the lobes are joined by concave line segments, and each lobe is comprised of a convex region, a concave transition region, and a nipple section extending to the outermost point of the lobe, with the lateral walls of the nipple section having essentially straight parallel walls.

In yet another embodiment (not illustrated), the pentalobal filament cross-section has a modification ratio of 2.4 to 5.0, wherein the perimeters of the lobes are joined by concave line segments, and each lobe is comprised of a convex region, a concave transition region, and a nipple section extending to the outermost point of the lobe with a parabolic or elliptical perimeter.

In each of the filament embodiments illustrated in FIGS. 1–4 and in the embodiments discussed but not illustrated, the lobes may be asymmetric. Preferably the lobes of filaments of the invention are symmetric.

To accomplish the apparently contradictory objectives of soft hand and high covering power, the filaments of the invention possess low denier, low moment of inertia and large modification ratio. Preferably, the filament denier is about 4 to about 20. More preferably, the filament denier is about 4 to about 15. Most preferably, the filament denier is about 4 to about 13.

Figure 5:
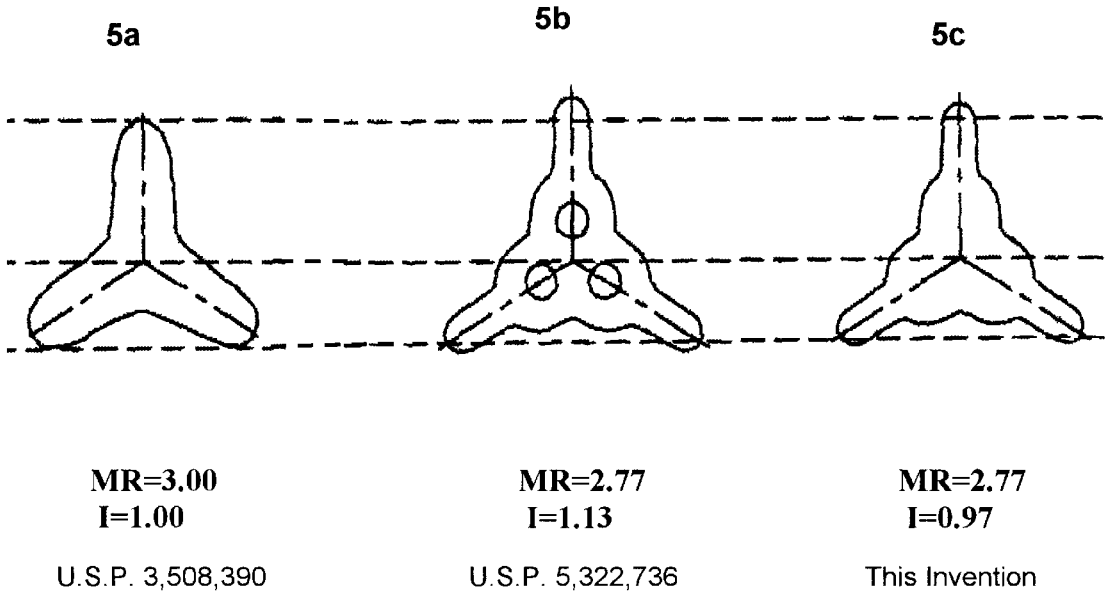
FIG. 5 shows transverse cross-sectional views drawn to scale of two prior art filaments, and a filament forming one embodiment of the invention, each having the same denier.

FIGS. 5*a* to 5*c* show cross-sectional views drawn to scale of two prior art filaments and one embodiment of a filament of the invention each having the same denier. Beneath each cross-section is shown the modification ratio and the relative moment of inertia. The outer dashed lines provide a reference to the transverse span of the filament cross-section shown in FIG. 5*a.* The reference for the moment of inertia and transverse span is the filament cross-section of U.S. Pat. No. 3,508,390 shown in FIG. 5*a.*

In comparison with the trilobal filaments of the prior art, the filaments of the invention possess at the same denier, either lower moment of inertia, providing increased softness, or larger span, providing greater covering power, or both. At the same denier, the filament of the invention shown in FIG. 5*c* possesses 10% greater span and 3% lower moment of inertia than the prior art fiber of U.S. Pat. No. 3,508,390, and 20% lower moment of inertia than the prior art fiber of U.S. Pat. No. 5,322,736.

The filaments are preferably formed by melt spinning, which involves extruding a molten polymer through a spinneret. The type of polymer or copolymer from which the filament is made can be any type typically used for carpet or upholstery yarn. Illustrative of such types are polyamide, polyester, polyolefin (especially polypropylene) and acrylic. "Polyamide" denotes nylon 6, nylon 66, nylon 4, nylon 12 and other polymers containing the —CONH— repeating unit as described in Cook, J., Handbook of Textile Fibres, Merrow Publishing Co., pp. 194–327 (1984). Nylon 6 and nylon 66 are preferred.

"Polyester" denotes polyethylene terephthalate (PET), polybutylene terephthalate (PBT), polytrimethylene terephthalate, (PTT), polyethylene naphthalate (PEN), polyalkylene adipate, polyesters of dihydric phenols, liquid crystal polymers and other polymers containing the —COO— repeating unit as described in Encyclopedia of Polymer Science and Engineering, Vol. 12, pub. by John Wiley & Sons, Inc., pp. 1–300 (2ed. 1989). PET is preferred.

The invention includes as embodiments yarns comprising the filaments of the invention. Each of the yarns of the invention are comprised of multiple filaments, wherein at least a majority of said filaments are solid multi-lobal filaments with a modification ratio of about 2.4 to about 5.0, the perimeters of the lobes being joined by concave line segments; and wherein upon traversing in one direction completely around the perimeter of each filament cross-section, the position of the center of curvature changes from one side of the perimeter to the other side at least eighteen times.

In one embodiment, among others, the yarn is comprised of multiple filaments, wherein at least a majority of the filaments are solid multi-lobal filaments with a modification ratio of about 2.4 to about 5.0, the perimeters of said lobes being joined by concave line segments; wherein each lobe is comprised of a convex region; a concave transition region; and a nipple section extending to the outermost point of the lobe, with the nipple section having lateral walls selected from the group consisting of elliptical, parabolic or straight.

In another embodiment, the yarn is comprised of multiple filaments, wherein at least a majority of said filaments are solid multi-lobal filaments with a modification ratio of about 2.4 to about 5, the perimeters of the lobes being joined by concave line segments; wherein each lobe is comprised of a first convex region; a first concave transition region; a second convex region; a second concave transition region; and a nipple section extending to the outermost point of the lobe; the nipple section having lateral walls selected from the group consisting of elliptical, parabolic or straight.

In yet another embodiment, the inventive yarn is comprised of multiple filaments, wherein at least a majority of said filaments are solid multi-lobal filaments with a modification ratio of about 2.4 to about 5, the perimeters of the lobes being joined by concave line segments; and wherein each lobe has a composite curve profile with a first arm angle a of about 5° to about 30°; a second arm angle β of about 60° to about 85°; a third arm angle γ of about 60° to about 85°; and a nipple section extending to the outermost point of the lobe, with the nipple section having lateral walls selected from the group consisting of elliptical, parabolic or straight.

Preferably, the yarn is comprised of multiple filaments, wherein at least a majority of the filaments are solid multi-lobal filaments with a modification ratio of about 2.4 to about 5, the perimeters of the lobes being joined by concave line segments; and wherein each lobe has a composite curve profile with a first arm angle α of about 5° to about 30°; a second arm angle β of about 60° to about 85°; and a nipple section extending to the outermost point of the lobe, with the nipple section having lateral walls that are essentially straight and converging.

A minor portion of a yarn of the invention may optionally be comprised of heat activated binder filaments having a lower melting point than the polymer constituting the filaments of the invention. Where the filaments of the invention are continuous filaments, the binder filaments are continuous filaments and may be incorporated in a yarn of the invention during twisting or by commingling. Where the filaments of the invention are staple filaments, the binder filaments are staple filaments and may be incorporated in a yarn of the invention by blending.

A yarn of the invention may also be comprised of an untwisted wrapped singles yarn having a core strand and a wrapper yarn as described in co-pending application Ser. No. 09/723,643, wherein the major portion of the core strand consists of filaments of the invention and at least the wrapper yarn contains a heat activated binder fiber.

When heat activated binder fibers are employed in a yarn of the invention, preferably the binder fibers will comprise about 0.05 to about 3 wt. % of a yarn of the invention.

In other embodiments, the invention includes carpets manufactured from multi-filament yarns of the invention. In each of these embodiments, a carpet of the invention is comprised of multi-filament yarns, wherein at least a majority of the filaments in the yarns are solid multi-lobal filaments with a modification ratio of about 2.4 to about 5, the perimeters of the lobes being joined by concave line segments; and wherein upon traversing in one direction completely around the perimeter of each solid trilobal filament cross-section, the position of the center of curvature changes from one side of the perimeter to the other side at least eighteen times.

Preferably, a carpet of the invention is comprised of multi-filament yarns, wherein a majority of the filaments in said yarns are solid multi-lobal cross-section having a modification ratio of about 2.4 to about 5.0, the perimeters of the lobes being joined by concave line segments; wherein each lobe has a composite curve profile with a first arm angle α ranging from about 5° to about 30°, a second arm angle β ranging from 60° to 85°, and a nipple section extending to the outermost point of the lobe, with the nipple section having lateral walls selected from the group consisting of elliptical, parabolic and straight. Most preferably, the lateral walls of the nipple section are straight and converging.

Figure 6:
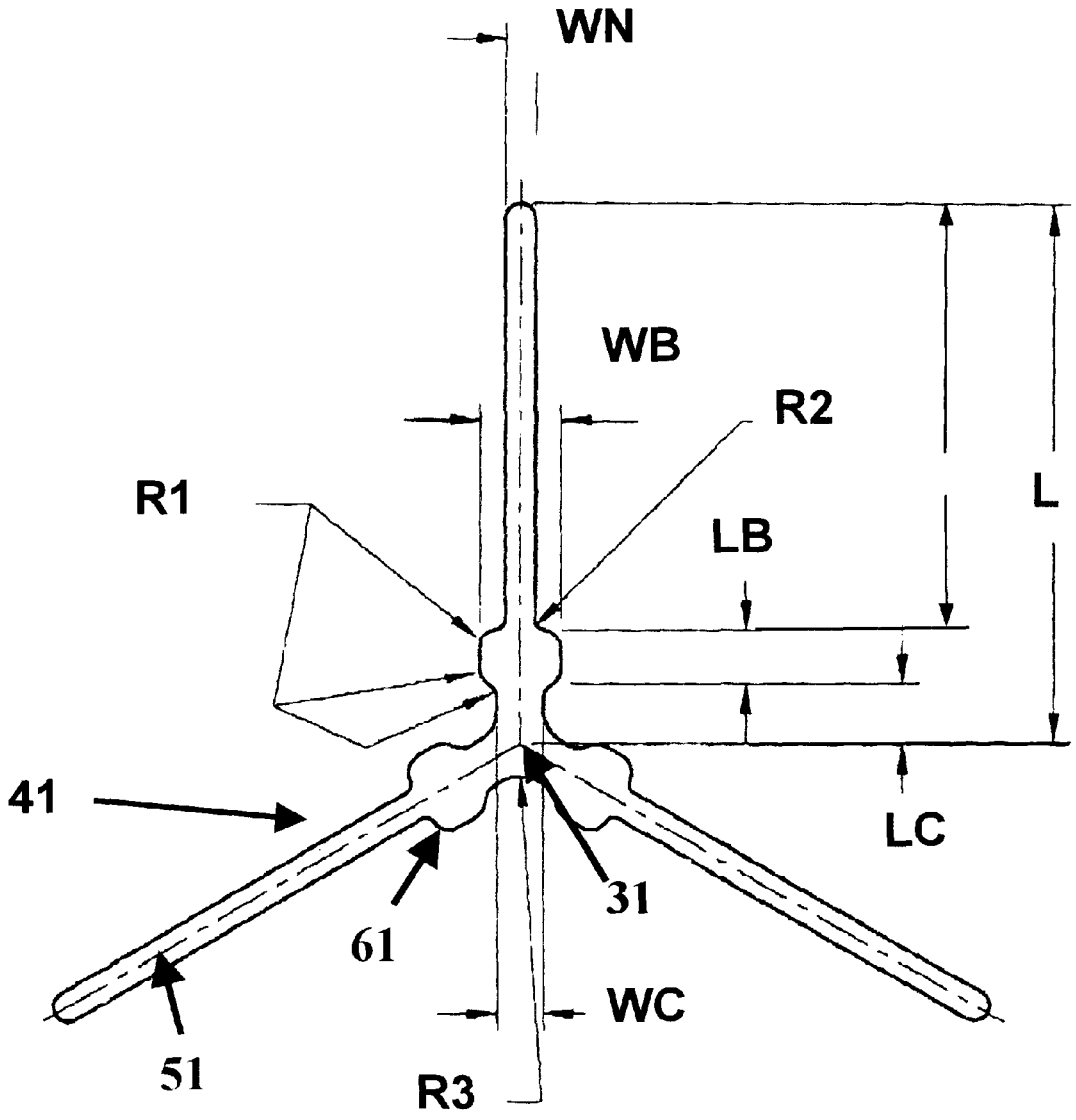
FIG. 6 is a cross-sectional view of an embodiment of a spinneret capillary, among others, used to make filaments of the invention.

An embodiment of a spinneret capillary of the invention, among others, is comprised of three legs originating at a central point in a trilobal central region, one or more contiguous bulge regions extending along each such leg from the central region, and a single nipple section extending from the outermost bulge region to the outermost point of each leg;

The cross-section of a spinneret capillary of the invention, among others, is illustrated in FIG. 6. It will be understood that a plurality of such capillaries will typically be formed in a single spinneret plate but an extruded product may be a single filament or a multi-filament yarn having any filament count.

The spinneret capillary embodiment shown in FIG. 6 is used to spin the filament having the cross-section shown in FIG. 1. Similar capillaries with four or five legs are used to spin the filaments shown in FIGS. 4*a* and 4*b* respectively. A capillary similar to that shown in FIG. 6 is used to spin the filament having the cross-section shown in FIG. 2 except as noted below.

The orifice of the capillary in FIG. 6 is comprised of three legs. Each leg of the orifice 41 originates at a central point in a trilobal central region 31. Immediately adjacent to the trilobal central region 31 along each leg is a bulge region 61. Preferably the bulge region is essentially rectangular. Beyond the bulge region 61 each leg 41 consists of a nipple section 51 which extends to the outermost point of each leg. The spinneret used to spin the filament having the cross-section shown in FIG. 2 additionally has a second bulge region along each leg contiguous to the first bulge region.

In FIG. 6, the length of the central region LC measured from the central point to the start of the bulge region is about 9 to about 13 percent of the overall length, L, of a leg. The length, LB, of the bulge region 61 along each leg is about 8 to about 11 percent of the overall length, L, of a leg. The length, LN of the nipple capillary section should be at least 40 percent of the total length, L, of the leg. Preferably, LN is at least 60 percent of L. More preferably, LN is about 80% of L.

The dimensions of the capillary are important to accomplishing the objectives of the invention. If the orifice area of the capillary is too large, it becomes impossible to draw the extruded filaments down to the desired low denier. On the other hand, If the dimensions of the capillary are too small, then several problems may be experienced. These include excessive pressure drop and plugging during spinning, difficulty in cleaning between production runs, and lack of robustness, i.e., easily damaged.

The orifice area of a capillary of the invention is about $4\times10^{-4}$ in$^2$ (0.26 mm$^2$) to about $11\times10^{+}$in$^2$ (0.71 mm$^2$), preferably about $5\times10^{-4}$ in$^2$ (0.38 mm$^2$) to about $8\times10^{-4}$ in$^2$ (0.45 mm$^2$). The width, WN, of the nipple section of the spinneret is about 0.003 inches (0.0762 mm) to about 0.004 inches (0.10 mm), preferably about 0.00325 inches (0.0826 mm). The length, LC, of the central region of the spinneret is about 0.0055 inches (0.140 mm) to about 0.0075 inches (0.190 mm), preferably about 0.0065 inches (0.165 mm). The width, WC, of the central region of the spinneret is about 0.004 inches (0.102 mm) to about 0.006 inches (0.152 mm), preferably 0.005 inches (0.127 mm). The radius of the perimeter of the central region, R3, is about 0.0025 inches (0.064 mm) to about 0.0045 inches (0.114 mm), preferably about 0.0035 inches (0.089 mm).

For the embodiment shown in FIG. 6, the length, LB, of the bulge region of the spinneret is about 0.0045 inches (0.114 mm) to about 0.0065 inches (0.165 mm), preferably about 0.0055 inches (0.140 mm). The corner radii, R1, are about 0.001 inch (0.0254 mm) to about 0.003 inches (0.076 mm), preferably about 0.002 inches (0.0508 mm). The corner radius, R2, is about 0.001 inch (0.0254 mm) to about 0.002 inches (0.051 mm). The angles between the legs of the capillary are about 100° to about 140°, preferably about 120°.

The method of the invention comprises the steps of: forming a melt of a filament-forming material; placing the melt in communication with a capillary spinneret, said spinneret defining one or more orifices, wherein each orifice is comprised of multiple legs originating at a central point in a multi-lobal central region, one or more contiguous bulge regions extending along each such leg from the central region, and a single nipple section extending from the outermost bulge region to the outermost point of each leg; extruding the melt through the orifices of the spinneret to form a melt stream; cooling to solidify said melt stream to form a multi-filament yarn; and drawing said yarn to a total draw ratio of about 1.5:1 to about 3.6:1.

The following examples are presented to provide a more complete understanding of the invention. The specific techniques, conditions, materials, proportions and reported data set forth to illustrate the principles of the invention are exemplary and should not be construed as limiting the scope of the invention.

EXAMPLES

Example 1

Yarn Preparation

A yarn of the invention was prepared as follows:

Nylon 6 polymer having a formic acid viscosity of 60 and containing 0.18% $TiO_2$ was melted and extruded at 250° C. at the rate of 38 lbs/hr (0.287 kg/min) through a 112 filament spinneret having orifices of the cross-section illustrated in FIG. 6. The extruded melt stream was drawn 160:1, cooled, and solidified. A spin finish was applied from an aqueous emulsion and the fiber bundle subsequently hot drawn 3:1 to produce a yarn of the invention with the solid trilobal cross-section shown in FIG. 1. The modification ratio of the filaments was 2.7. The first arm angle $\alpha$ was 15°. The second arm angle $\beta$ was 70°. The angles between the lobes were about 120°.

The yarn was steam texturized in a stuffer tube and air-jet commingled in-line after drawing. Several yarn packages were produced. After texturing and commingling the yarn was about 1120 denier×112 filaments (10 denier/fil). Yarn tensile properties were 3.5 g/d tenacity, 10.4 g/d initial modulus, and 40% ultimate elongation.

A yarn was also prepared having the prior art solid trilobal cross-section shown in FIG. 5*a*. This yarn was prepared in a similar manner as follows:

Nylon 6 polymer having a formic acid viscosity of 60 and containing 0.18% $TiO_2$ was melted and extruded at 253° C. at the rate of 38 lbs/hr (0.287 kg/min) through a 112 filament spinneret having orifices with the cross-section illustrated in FIG. 3 of U.S. Pat. No. 3,508,390 heretofore incorporated by reference. The extruded melt stream was drawn 76:1, cooled, and solidified. Spin finish was applied from an aqueous emulsion and the fiber bundle subsequently hot drawn 3:1 to produce a yarn with the solid trilobal cross-section shown in FIG. 5*a*.

The yarn was steam texturized in a stuffer tube and air-jet commingled in-line after drawing. Several yarn packages were produced. After texturizing and commingling the yarn was about 1120 denier×112 filaments (10.0 denier/fil). The filaments had a modification ratio of 3.0 and an arm angle of 14°. The angles between the lobes were about 120°. Yarn tensile properties were 3.2 g/d tenacity, 10.2 g/d initial modulus and 42% ultimate elongation.

Example 2

Carpet Preparation

Carpets were prepared from the yarns produced in Example 1. Some yarns were commingled with a 30 denier/12 filament low melting nylon binder fiber to produce an 1150 denier yarn containing 2.61% of binder fiber. All yarns were twisted, and plied with another yarn to produce either a 5.5×5.5 turns/inch (2.17 turns/cm) or a 6.5×6.5 turns/inch ((2.56 turns/cm) 2-ply twisted yarn. The 2-ply twisted yarns were subjected to a twist setting operation in a Superba process at 126° C. that melted the binder fibers, if any.

The twist set yarns were tufted in a polypropylene backing at a density of either 45 oz/yd$^2$ (1.53 kg/m$^2$) or 53 oz/yd$^2$ (1.80 kg/m$^2$) to a pile height of 22/32 inch (1.75 cm) to produce a number of experimental 33 cm×46 cm carpet samples. The individual carpet samples were dyed at 60° C. in a fluid dyeing process with a combination of acid dyes from Ciba Specialty Chemicals in the presence of conventional surfactants and buffers to produce a color designated "Kayak Tan". The dye concentrations were as follows:

TECTILON® Yellow 3R KWL 200-0.0374 g/L

TECTILON® Red 2B N 200%-0.0175 g/L

TECTILON® Blue 4RS KWL 100 acid dye-0.0234 g/L

Dye solution pH was 7.5±0.2.

The dyed carpets were back coated and sheared using conventional methods.

Carpet Evaluation Methods

The carpets were evaluated by several means. Carpet body was quantitatively measured by essentially the method of Southern et al., "Fundamental Physics of Carpet Performance", *J. Appl. Poly. Sci., Appl. Poly. Symp.,* 47, 355–371 (1991). Higher body measurements are superior.

Luster was qualitatively judged by an expert panel consisting of four persons knowledgeable in carpet construction and evaluation. The carpets of the invention and the carpets containing the prior art fibers were aligned in rank order of luster without knowledge of which yarn was used in its construction. Numerical ratings were assigned on a scale of one to ten with one corresponding to the lowest luster and ten corresponding to the highest luster. A difference in rating of one unit is a perceptible difference.

For several matched pairs of experimental carpet samples having the same construction, one containing a yarn of the invention and the other containing the prior art fibers, photographs were taken of the carpet surface. The photographs were subjected to quantitative image analysis to determine the percentage of the carpet surface covered by yarn tufts, the relative void size between tufts and the "evenness" of coverage, i.e., the variation in the distance between the center of a tuft and its four nearest neighbors.

Smaller void size and smaller evenness numbers represent better coverage and a more uniform carpet texture.

Results of Carpet Evaluations

Figure 7:
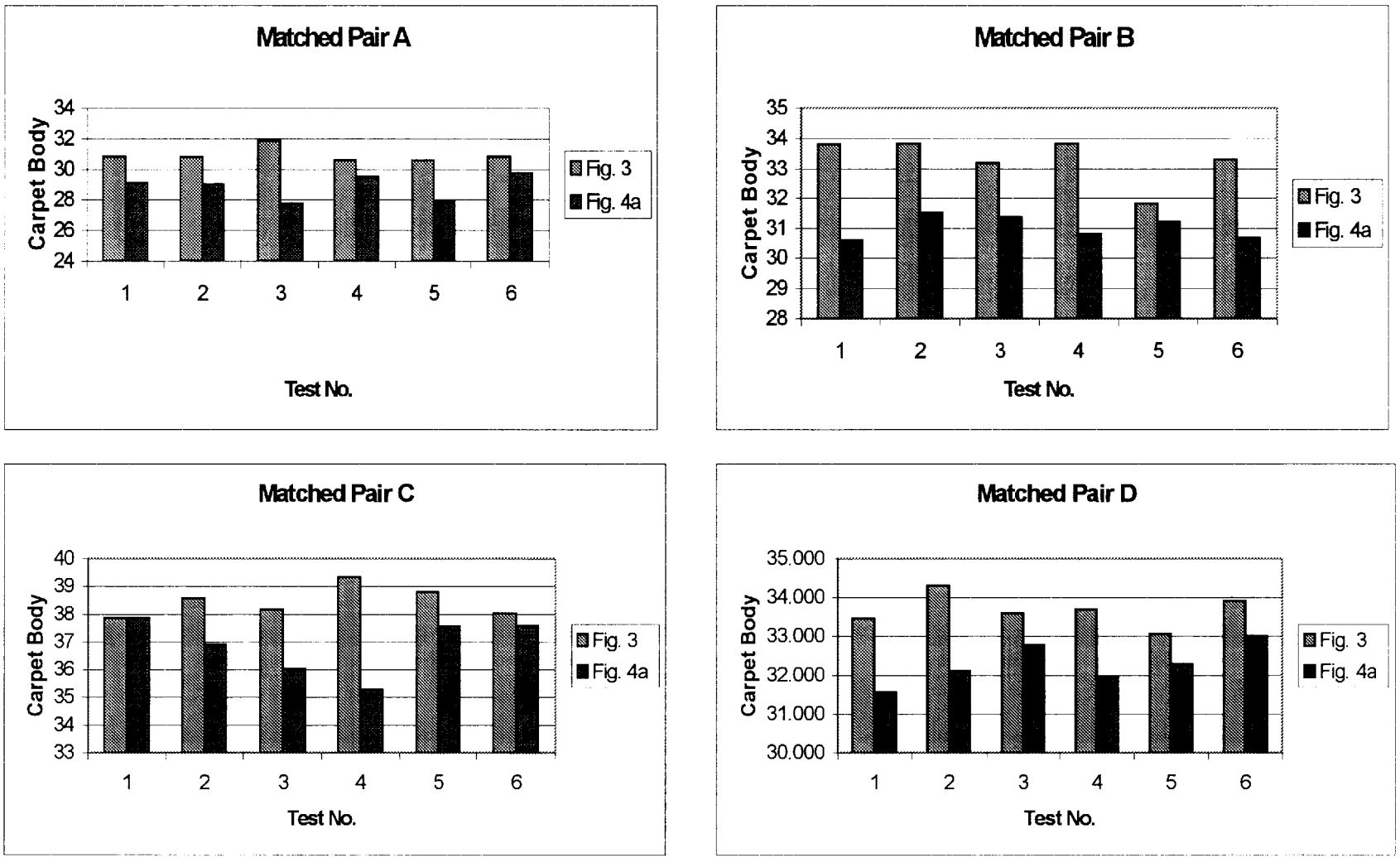
FIG. 7 shows the body data measured on matched pairs of carpets comprising either inventive filaments or prior art filaments.

A summary of properties of the carpets prepared as discussed above is presented in Table III as a comparison of matched pairs of carpets: one with the inventive fibers having the cross-section of FIG. 1, and the other with the prior art fibers having the cross-section of FIG. 4*a,* other factors remaining the same. The body measurements in Table 3 are the average for six locations within a carpet sample. The individual carpet body measurements represented in the averages of Table III are shown in FIG. 7.

The figures for luster represent the consensus of the expert panel.

Discussion

It will be seen from the averages in Table III that the carpets comprising the yarns and filaments of the invention had higher body than the carpets comprising the prior art filaments. It will also be seen from Table III that carpets comprising the yarns and filaments of the invention had less luster than the carpets comprising the prior art filaments. The coverage was greater for the carpets comprising the yarns and filaments of the invention, the relative void size between the tufts was smaller and the evenness of the tufts (texture) was more uniform.

In each of these respects, the carpets comprising the yarns and filaments of the invention were superior to the carpets comprising the prior art filaments.

ratio of the filaments was 2.7. The first arm angle α was 15°. The second arm angle β was 70°. The angles between the lobes were about 120°.

The yarn was steam texturized in a stuffer tube and air-jet commingled in-line after drawing. After texturing and commingling the inventive yarn was about 1120 denier×140 filaments (8.0 denier/fil).

Similarly, a yarn is prepared having a prior art hollow trilobal cross-section using a spinneret having the same minimum capillary slot dimension as above. Nylon 6 polymer having a formic acid viscosity of 60 is melted and extruded at 250° C. at the rate of 38 lbs/hr (0.568 kg/min) through a 84 bore group spinneret of the design shown in FIG. 5 of U.S. Pat. No. 5,322,736 heretofore incorporated by reference. The slot width of the nipple capillary (dimension W in FIG. 5 of U.S. Pat. No. 5,322,736) has a dimension of 0.00325 inches (0.0826 mm). This is the same minimum slot width as used for spinning the solid trilobal filament described immediately above. However, the total orifice area of a bore group is $11.39\times10^{-4}$ in$^2$ (0.735 mm$^2$). The orifice area of the hollow trilobal spinneret is significantly larger than for the solid trilobal spinneret in order to accommodate the elements forming the hollows.

The extruded melt stream is drawn 200:1, cooled and solidified. Spin finish is applied from an aqueous emulsion and the fiber bundle is subsequently hot drawn maximally about 3:1 to produce a yarn with the prior art hollow trilobal cross-section shown in FIG. 1 of U.S. Pat. No. 5,322,736.

TABLE III

Carpet Comparisons

All yarns 1120 denier × 112 filaments exclusive of binder. All carpet pile heights 22/32 inch.

| | | Yarn | | Carpet | | | | | |
|---|---|---|---|---|---|---|---|---|---|
| Matched Pair | Fiber X-section | Wt. % Binder | Twist, tpi | OZ/SQ. YD. | Bulk | Luster | % Coverage | Relative Void Size | Evenness |
| A | FIG. 1 | 2.61 | 6.5 × 6.5 | 45 | 30.92 | 8 | 64.1 | 2.38 | 4.52 |
| | FIG. 4a | 2.61 | 6.5 × 6.5 | 45 | 28.84 | 10 | 53.7 | 2.50 | 6.59 |
| B | FIG. 1 | 2.61 | 5.5 × 5.5 | 45 | 33.30 | 4 | 79.1 | 0.42 | 6.20 |
| | FIG. 4a | 2.61 | 5.5 × 5.5 | 45 | 31.03 | 7 | 64.9 | 1.00* | 6.35 |
| C | FIG. 1 | 2.61 | 5.5 × 5.5 | 53 | 38.46 | 4 | 76.6 | 0.50 | 5.95 |
| | FIG. 4a | 2.61 | 5.5 × 5.5 | 53 | 36.86 | 6 | 73.2 | 0.73 | 6.51 |
| D | FIG. 1 | 0 | 5.5 × 5.5 | 45 | 33.67 | 1 | n.a. | n.a. | n.a. |
| | FIG. 4a | 0 | 5.5 × 5.5 | 45 | 32.28 | 2 | n.a. | n.a. | n.a. |

*Reference sample
n.a. - not available

Example 3

The following example illustrates the difference in deniers obtainable when spinning a solid trilobal filament of the invention and a prior art hollow trilobal filament when the respective spinnerets have the same minimum capillary slot dimension.

Nylon 6 polymer having a formic acid viscosity of 60 and containing 0.18% $TiO_2$ was melted and extruded at 250° C. at the rate of 38 lbs/hr (0.287 kg/min) through a 140 filament spinneret having orifices of the cross-section illustrated in FIG. 6. The width of the spinneret nipple section WN was 0.00325 inches (0.0826 mm). The total area of an orifice was $6.8\times10^{-4}$ in$^2$ (0.439 mm$^2$).

The extruded melt stream was drawn 200:1, cooled and solidified. Spin finish was applied from an aqueous emulsion and the fiber bundle subsequently hot drawn maximally about 3:1 to produce a yarn of the invention with the solid trilobal cross-section shown in FIG. 1. The modification ratio of the filaments is 2.7. The first arm angle α is 15°. The second arm angle β is 70°. The angles between the lobes are about 120°.

The yarn is steam texturized in a stuffer tube and air-jet commingled in-line after drawing. After texturing and commingling the yarn is about 1120 denier×84 filaments (13.4 denier/fil).

A comparison of the solid trilobal yarn of the invention with the prior hollow trilobal yarn, each spun with the same minimum spinneret opening dimension, shows the inventive solid trilobal filaments to be of 40% lower denier (8.0 denier/fil vs. 13.4 denier/fil). As lower filament denier yarns produce carpets with softer hand, this is a significant advantage of the yarns of the invention.

Example 4

It is desired to produce staple filaments having the hollow trilobal cross-section shown in FIG. 1 of U.S. Pat. No. 5,322,736 at low denier. To achieve this, a 163 bore group spinneret is fabricated having small openings and small orifice area. The spinneret is of the design illustrated in FIG. 5 of U.S. Pat. No. 5,322,736. The capillary slot width of a bore group has a dimension of only 0.0025 inches (0.0508 mm), and the total orifice area of a bore group is $8.76\times10^{-4}$ $in^2$ (0.565 $mm^2$).

A nylon 6 polymer of 60 formic acid viscosity is melted and extruded at the rate of 67.5 lbs/hr (0.511 kg/min). The extruded melt stream is drawn 200:1, cooled and solidified into a 163 filament bundle. Spin finish is applied from an aqueous emulsion and the fiber bundle is hot drawn maximally about 3:1. The yarn is steam crimped in a crimp box and chopped into staple. The staple filaments are of 10.7 denier.

The spinneret accumulates a deposit of a hard, glassy carbonaceous and mineral material during spinning. The severity of the deposition depends on the cleanliness of the polymer and the extent of prior melt filtration in the spin pack. When the spinning run is completed, the spinneret is attempted to be cleaned by the normal procedure. The spinneret is first heated in a "burn-out" oven for 6 hours at about 510° C. The cooled spinneret is ultrasonically cleaned in hot soapy water and blown dry with compressed air. Normally, a small amount of remaining residue would be readily removed from the spinneret with a very small pick with the aid of a microscope.

However, at the end of this burn-out and ultrasonication, considerable residue remains lodged in the narrower spinneret orifices that proves very difficult to remove. The small openings of this spinneret prevent effective use of a pick to remove residue without damaging the edges of the orifices. The spinneret is subjected to a second burn-out period at higher temperature (540° C.) and ultrasonication. The remaining residue is removed under the microscope only with substantial difficulty.

The long and labor intensive cleaning process required when a spinneret bore group has openings smaller than about 0.003 inches (0.0702 mm) discourages this approach to obtaining lower denier filaments under present circumstances of polymer cleanliness, melt filtration technology and spinneret cleaning methods. When those circumstances and technology are improved, it will nevertheless remain true, that at the same minimum capillary slot dimension, a spinneret to produce a solid trilobal filament will have a smaller orifice area than a spinneret to produce a hollow trilobal filament. It will therefore always be possible, for the same minimum spinneret opening, to produce the inventive solid trilobal filaments at lower denier than the prior art hollow trilobal filaments.

Example 5

Nylon 6 polymer having a formic acid viscosity of 60 was dried at 110° C. in a vacuum oven for 16 hrs, melted and extruded at 262° C. at the rate of 0.67 g/min through a single orifice spinneret of the inventive design illustrated in FIG. 6. The smallest opening of an orifice had a dimension of 0.00325 inches (0.0826 mm) and had a total area of $6.8\times10^{-4}$ $in^2$ (0.439 $mm^2$). The melt stream was maximally drawn, cooled, solidified, maximally drawn 3.1:1 on a hot roll at 157° C., and wound. The final monofilament was of 4.1 denier having the cross-section illustrated in FIG. 1.

Example 6

The following example illustrates the differences in softness and color intensity between carpets made from a solid trilobal fiber of the invention and a prior art hollow trilobal fiber of the same denier in the same carpet construction.

Nylon 6 yarns of about 1400 denier×80 filaments (17.5 denier/fil) were spun of each of the solid trilobal cross-section of the invention illustrated in FIG. 5*c* and the prior art hollow trilobal cross-section illustrated in FIG. 5*b*. Singles yarns were tufted in non-woven backings and sheared to a pile height of 5/16 inch at a density of 12.1 $oz/yd^2$ (0.41 $kg/m^2$) to produce carpet samples from each yarn. This carpet construction is typical for an automotive flooring application.

The individual carpet samples were dyed with TECTILON® acid dyes from Ciba Specialty Chemicals at 60° C. using either TECTILON® Yellow 3R KWL 200, TECTILON® Red 2BN 200% or TECTILON® Blue 4RS KWL 100 using a range of dye concentrations in a fluid dyeing process.

The carpet samples dyed with the same color dye at the same concentration were compared by an expert panel for color intensity. At each dye and dye concentration, it was found that color intensity was lower for the hollow trilobal filaments than for the solid trilobal filaments of the invention. Carpets of the same color intensity were produced only when the dye concentration in the dyeing solution was about 20 to 25% higher for the hollow trilobal filaments than for the solid trilobal filaments of the invention.

It should also be noted that yarn-to-yarn variations of void volume in hollow trilobal filaments and consequent variation in dyed color intensity may cause visible streaking in carpets constructed therefrom.

With respect to the "hand" of the above carpet samples, four carpet experts were asked to determine which was the softest. Each expert found that the carpet made from the solid trilobal fibers of the invention were noticeably softer than the carpet made from the prior art hollow trilobal fibers, Example 7

Nylon 6 polymer having a formic acid viscosity of 60 is melted and extruded at 250° C. at the rate of 38 lbs/hr (0.568 kg/min) through a 94 filament spinneret. The extruded melt stream is drawn 200:1, cooled and solidified. Spin finish is applied from an aqueous emulsion the filament bundle subsequently hot drawn maximally about 3:1 to produce a yarn with the solid trilobal cross-section illustrated in FIG. 3. The modification ratio of the filaments is about 4. The first arm angle $\alpha$ is 15°. The second arm angle $\beta$ is 70°. The third arm angle $\gamma$ is 75°. The angles between the lobes are about 120°. The yarn is steam texturized in a stuffer tube and air-jet commingled in-line with drawing. After texturing and commingling the yarn is about 1160 denier×94 filaments (12.4 denier/fil). The filament cross-sections are of the more complex embodiment shown in FIG. 3.

Having thus described the invention in rather full detail, it will be understood that such detail need not be strictly adhered to but that further changes and modifications may suggest themselves to one skilled in the art, all falling within the scope of the invention as defined by the subjoined claims.

What is claimed is:

1. A filament comprising a solid cross-section having a perimeter comprised of a plurality of symmetric lobes that are joined to one another by concave line segments, said cross-section having a modification ratio of about 2.4 to about 5; wherein upon traversing in one direction completely around the perimeter, the position of a center of curvature for the perimeter changes from one side of said perimeter to the other side at least eighteen times.

2. The filament of claim 1, wherein each lobe is comprised of a convex region; a concave transition region; and a nipple section extending to the outermost point of the lobe, said nipple section having lateral walls selected from the group consisting of elliptical, parabolic or straight.

3. The filament of claim 1, wherein each lobe is comprised of a first convex region; a first concave transition region; a second convex region; a second concave transition region; and a nipple section extending to the outermost point of the lobe, said nipple section having lateral walls selected from the group consisting of elliptical, parabolic or straight.

4. The filament of claim 1, wherein each lobe has a composite curve profile having a first arm angle $\alpha$ of about 5° to about 30°; and a second arm angle $\beta$ of about 60° to about 85°; and a nipple section extending to the outermost point of the lobe, said nipple section having lateral walls selected from the group consisting of elliptical, parabolic and straight.

5. The filament of claim 1, wherein each lobe has a composite curve profile having a first arm angle $\alpha$ of about 5° to about 30°; a second arm angle $\beta$ of about 60° to about 85°; and a third arm angle $\gamma$ of about 60° to about 85°; and a nipple section extending to the outermost point of the lobe, said nipple section having lateral walls selected from the group consisting of elliptical, parabolic and straight.

6. The filament of claim 1, wherein the number of lobes is at least three.

7. The filament of claim 6, wherein the lobes are substantially equispaced.

8. The filament of claim 1, wherein the number of lobes is three, four or five.

9. The filament of either claim 2, 3, 4 or 5, wherein said lateral walls of said nipple section are essentially straight and parallel.

10. The filament of either claim 2, 3, 4 or 5, wherein said lateral walls of said nipple section are essentially straight and converging.

11. The filament of either claim 2, 3, 4 or 5, wherein said lateral walls of said nipple section are selected from the group consisting of parabolic or elliptical.

12. A filament comprising a solid cross-section having a perimeter comprised of a plurality of lobes that are joined to one another by concave line segments, said cross-section having a modification ratio of about 2.4 to about 5; wherein each lobe has a composite curve profile having a first arm angle $\alpha$ of about 5° to about 30°, a second arm angle $\beta$ of about 60° to about 85° and a third arm angle $\gamma$ of about 60° to about 85°; and a nipple section extending to the outermost point of the lobe, said nipple section having lateral walls selected from the group consisting of elliptical, parabolic and straight; and wherein upon traversing in one direction completely around the perimeter, the position of a center of curvature for the perimeter changes from one side of said perimeter to the other side at least eighteen times.

* * * * *